United States Patent [19]

Butler et al.

[11] 4,266,015

[45] May 5, 1981

[54] LIGHT SENSITIVE MATERIALS WITH FLUORINATED POLYMER ANTISTATS

[75] Inventors: Louis Butler, Harlow; Paul H. Ogden, Southport, both of England

[73] Assignee: Minnesota Mining and Manufacturing Company, St. Paul, Minn.

[21] Appl. No.: 832,945

[22] Filed: Sep. 13, 1977

[51] Int. Cl.[3] ..... G03C 1/78

[52] U.S. Cl. ..... 430/527; 430/536

[58] Field of Search ..... 96/87 A, 87 R, 62, 50 PL; 526/245; 430/527, 536

[56] References Cited

U.S. PATENT DOCUMENTS

| | | | |
|---|---|---|---|
| 2,090,016 | 3/1937 | Young et al. | 96/50 PL |
| 2,391,181 | 12/1945 | Minsk et al. | 96/50 PL |
| 2,642,416 | 6/1953 | Ahlbrecht et al. | 269/31.2 R |
| 3,384,627 | 5/1968 | Anello et al. | 526/245 |
| 3,386,977 | 6/1968 | Kleiner | 526/245 |
| 3,591,379 | 6/1971 | Plakunov | 96/67 |
| 3,617,354 | 11/1971 | Carnaham et al. | 96/50 PL |

*Primary Examiner*—Jack P. Brammer

*Attorney, Agent, or Firm*—Cruzan Alexander; Donald M. Sell; Mark A. Litman

[57] ABSTRACT

Light sensitive elements containing silver halide emulsions can be desensitized to static charge marking by the addition of fluorine-containing polymers of a defined class.

11 Claims, No Drawings

LIGHT SENSITIVE MATERIALS WITH FLUORINATED POLYMER ANTISTATS

This invention relates to light-sensitive photographic silver halide materials.

During their manufacture and processing, light-sensitive materials are moved while in contact with rollers or other surfaces, and under some conditions, e.g. low humidity, static charges can build up on the materials. The discharge of such charges over the surface of light-sensitive material can cause a 'static mark' when the silver halide emulsion layer is developed. The charge build up can be negative or positive, but it is found that discharge of the latter gives particularly prominent static marks.

It is therefore an object of this invention to reduce or eliminate the incidence of these static marks.

According to the invention there is provided a light-sensitive material which includes a support, at least one layer of a photographic silver halide emulsion on at least one face of the support, and an outer layer over said at least one layer which is a top coat comprising a fluorine-containing homo- or co-polymer which has been derived from a fluorine-substituted straight or branched chain alkyl (as herein defined) ester of an ethylenically unsaturated carboxylic acid and the said fluorine-containing polymer being optionally additionally present in all or a least one of the emulsion layers on at least one face of the support or in another layer intermediate the top coat and said at least one face of the support.

The fluorine-containing polymers (and copolymers) of the present invention are those which contain from 2 to 100% by weight of units derived from straight or branched chain fluorinated alkyl esters of ethylenically unsatuarated carboxylic acids wherein there are no more than one H or Cl per two carbon atoms on the fluorinated alkyl group and no more than one skeletal O or N per two carbon atoms on the fluorinated alkyl group.

When light-sensitive materials are moved in contact with steel or rubber rollers, as is often the case for example, in high-speed apparatus employed for radiographic examinations, a much-reduced positive charge or even a slight negative charge is built up on the surface of the material as compared with a similar material not containing the fluorine-containing polymer. Therefore the incidence of static marks on materials of the invention, and particularly the undesirable ones arising from positive charges, is substantially reduced and in most instances can be eliminated altogether.

The invention is applicable to all types of silver halide photographic materials but is particularly useful in radiographic materials because these are generally handled in high speed apparatus in low humidity conditions. Such materials generally have at least one silver halide emulsion coating on each face of the support and so the materials of the invention will preferably have identical coatings and layers on both sides of the support. This is not essential however.

The top coat can be either a separate layer comprising the fluorine-containing polymer positioned over all the other layers of the material on one or both faces of the support or alternatively the fluorine-containing polymer can be incorporated in a top coat protecting layer positioned over the emulsion layer or layers on one or both faces of the support. It appears that the presence of the fluorine-containing polymer at the surface of the light-sensitive material is most effective in preventing substantial static charge build up. Also the fluorine-containing polymers are relatively expensive and so positioning them at the surface of the material makes more effective use of these polymers than when they are positioned within a layer of the material. Therefore it is generally possible to use smaller amounts of them when in the top coat than within, for example, an emulsion layer.

The top coat can consist solely of the fluorine-containing polymer. Thus the light-sensitive material can be given a final coating of a lacquer of the fluorine-containing polymer in a volatile liquid, e.g. an organic liquid such as acetone, trifluoroethanol, or 'Arcton 113' which is a fluorine-containing solvent sold by Imperial Chemicals Industries Limited, or an emulsion, e.g. an aqueous emulsion of the fluorine-containing polymer. Alternatively, a mixture of a colloid such as gelatin and a compatible fluorine-containing polymer can be spread as a top coating over the silver halide emulsion layer or layers. In the latter case the mixture can include a hardener, e.g. an aldehyde hardener for gelatin, so that the fluorine-containing polymer becmes incorporated in a hardened protective top coat for the material.

Light-sensitive materials have a support, e.g. a film base such as one of polyester, coated with one or more layers of photographic silver halide emulsion. The support may have one or more subbing layers between it and the layer of silver halide emulsion and there may be intermediate layers between the layers of silver halide emulsion when there is more than one layer. Over the outer silver halide layer may be a protective coat, e.g. of hardened gelatin, and the compatible fluorine-containing polymer can be included in this protective coat or the fluorine-containing polymer can be spread as a layer over this protective coat. In the case of light-sensitive materials for radiographic uses, the support generally has at least one silver halide emulsion layer on each face of the support and a top coat containing the fluorine-containing polymer can then be positioned over the silver halide emulsion layer or the outer layer on each face of the support.

The amount of fluorine-containing polymer incorporated in the top coat can be varied within wide limits and in some cases the top coat can consist entirely of the polymer. It may generally constitute 2 to 100% of the top coat. In other cases where it is incorporated with other materials in the top coat it can constitute, for example 2 to 90% and more preferably 20 to 40% by weight of the total weight material of that top coat, e.g. gelatin plus polymer. These polymers may be combined with any hydrophilic colloidal binder or photographic binder known in the art as useful in photographic elements if it is compatible therewith.

When the fluorine-containing polymer is incorporated in the top coat in the form of an aqueous latex, the polymer can conveniently be made by emulsion polymerization.

In order to prevent or reduce the chance of static buildup and so the incidence of static marks during the manufacture of the light-sensitive materials of the invention before the top coat is applied, one can add a fluorine-containing polymer to all or to at least one of the silver halide emulsion layers or an intermediate layer or layers between the emulsion layers or between an emulsion layer and the base. In such a case the fluorine-containing polymer is desirably incorporated in the layer in the form of an aqueous emulsion and it must be compatible with the other components, e.g. gelatin or other colloid, in the layer. When the polymer is incorporated in a silver halide emulsion layer it can preferably constitute, for example, 5 to 50% by weight of the colloid in that layer.

The fluorine-containing polymer can be a homopolymer or a copolymer containing at least one fluorine-containing monomer. In either case the monomer or one of the monomers contains a fluorinated saturated, monovalent, non-aromatic, alkyl group defined as follows, the carbon chain of this alkyl group may be straight, branched or, if sufficiently large, cyclic and may be interrupted by divalent oxygen atoms or trivalent nitrogen atoms bonded only to carbon atoms: preferably, the chain does not contain more than one hetero atom, e.g. one nitrogen or oxygen atom for every two carbon atoms in the skeletal chain. A fully fluorinated group is preferred but hydrogen or chlorine atoms may be present as substituents in the fluorinated alkyl group although preferably not more than one atom of either is present in the radical for every two carbon atoms, and preferably the group contains at least a terminal perfluoromethyl group. In general an increase in the number of fluorine atoms is found to give a reduction in the likelihood of charge build-up on the photographic material and accordingly the incidence of static marks on the developed material.

Suitable fluorine-substituted straight or branched chain alkyl esters of ethylenically unsaturated carboxylic acids are esters of acrylic and methacrylic acids. Examples of suitable monomers, the resulting polymers and their preparation are described in U.S. Pat. No. 2,642,416. The monomers disclosed in that patent have the general formula:

$$CH_2{=}CHCOOCH_2C_nF_{2n+1}$$

where n is an integer from 3 to 9.

Other suitable monomers are $$CH_2{=}CH\ COO\ CH\ (CF_3)_2 \text{ and } CH_2{=}\underset{\underset{CH_3}{|}}{C}\ COO\ CH_2(C_nF_{2n+1})$$

These monomers can be homopolymerized on their own or copolymerized with other ethylenically unsaturated monomers. Specific examples of suitable monomers are hexafluoro-iso-propyl acrylate, trifluorethyl acrylate, 1,1-dihydroperfluoro-octyl methacrylate and 2,2,3,3,4,4,4,-heptafluoro-n-butyl acrylate. Of these the latter is readily available and found to give good results when used according to the invention. Typical comonomers would be acrylic acid, methacrylic acid and substituted derivatives thereof. Where copolymers are used, at least 2% by weight for top coat or other coated layers must be derived from the fluorine-containing polymers of the present invention.

Monomer precursors for the preparation of fluorinated polyacrylates are conveniently obtained by reacting acrylyl chloride or methylacrylyl chloride with a perfluoroalkyl substituted alcohol in the presence of a suitable acid acceptor such as a tertiary amine, i.e. pyridine or triethylamine. Thereafter these monomers can readily be polymerized by free-radical polymerization for example, in an aqueous emulsion to give an aqueous polymer latex. This emulsion polymerization can be effected in the presence of dispersing agents such as sodium alkyl sulphate.

The type and nature of the silver halide emulsion is not critical.

The incorporation of the fluorine-containing polymers into the top coats of light-sensitive materials according to the invention and optionally additionally into the silver halide layer or layers does not deleteriously affect the photographic properties of the light-sensitive materials. In particular these polymers are transparent when present in a dried layer and so do not affect the optical clarity of images developed in the light-sensitive materials of the invention.

The invention will now be illustrated by the following Preparations and Examples in which all parts and percentages are by weight unless otherwise specified.

PREPARATION 1

Poly(hexafluoroisopropyl acrylate)

To a cooled and well stirred solution of 1,1,1,3,3,3,-hexafluoroisopropyl alcohol (1 gram mole) and acrylyl chloride (1 gram mole) in ether (500 ml) was slowly added a solution of triethylamine (1 gram mole) in ether (200 ml). The resulting slurry was stirred for several hours at room temperature and then refluxed for a further hour, after which it was cooled and filtered. The filtrate was then washed successively with water, aqueous sodium bicarbonate and water. The washed ether layer was then dried over magnesium sulphate and distilled to produce essentially pure 1,1,1,3,3,3,-hexafluoro-iso-propyl acrylate (boiling point 85° C.).

An emulsion containing 1,1,1,3,3,3,-hexafluoro-isopropyl acrylate (100 g), sodium lauryl sulphate (1.0 g), ammonium persulphate (0.1 g) and water (100 ml) was heated to 80° C. with good stirring, and maintained at this temperature for one hour. Steam was then blown through the heated emulsion to remove any residual monomer and the monomer-free latex was allowed to cool. It was subsequently filtered through wire gauze to remove any coagulated polymer and at this stage was suitable for incorporation into photographic light-sensitive materials as described in the following Examples.

PREPARATION 2

Poly(2,2,3,3,4,4,4-heptafluoro-n-butyl-acrylate)

Following the procedure of Preparation 1, this polymer was prepared from 2,2,3,3,4,4,4-heptafluorobutanol and acrylyl chloride.

PREPARATION 3

Poly(1,1-dihydroperfluoroctyl methyacrylate)

Following the procedure of Preparation 1, this polymer was prepared from 1,1-dihydroperfluoroctanol and methacrylyl chloride.

EXAMPLE 1

A coarse-grain gelatin-silver bromoiodide emulsion of polyhedral habit and containing 1.75 moles percent of iodide, was prepared by ripening in an ammonia/bromide environment to achieve a mean grain size of 1.45μ. At the end of ripening the emulsion was coagulated, washed and dispersed in gelatin to give a silver/gelatin ratio by weight of about 1.35 to 1. The emulsion was then digested with a sulphur and a gold sensitiser, and stabilized at the end of digestion.

The emulsion was then divided into two parts. To part 1 no addition was made while to part 2 were added 20 g of poly (hexafluoro-iso-propyl acrylate), as an approximately 10% dispersion in water, per mole of silver halide.

After the addition of the usual coating aids and hardener the emulsions were coated on both sides of polyester base to give a total silver coating weight of 9 g/m$^2$.

The emulsion layers of part 1 were then coated with a protective all-gelatin top coat containing a gelatin hardener to give a light-sensitive material called Sample 1. The emulsion layers of part 2 were coated with a protective top coat consisting of 40% poly(hexafluoro-iso-propyl acrylate) and 60% gelatin and a gelatin hardener to give a light-sensitive material called Sample 2. Both samples were dried under identical controlled conditions.

The static charging characteristics of the samples were then tested. The samples were first conditioned for 48 hours in an atmosphere having a controlled relative humidity of 38%. Any residual electrostatic charges were neutralized before testing. The film samples were then passed a number of times under a stainless steel roller. The induced charge, due to the frictional effect of the roller, was measured by means of a probe connected to an electrometer. The charge generated after twenty passes under the roller was measured and the results are shown below in Table I.

TABLE I

| Sample | Emulsion Poly(hexafluoro-iso-propyl acrylate) g/mole AgX | Top Coat % Poly(hexafluoro-iso-propyl acrylate) | Induced Static Charge (Volts) |
|---|---|---|---|
| I | 0 | 0 | +44 |
| II | 20 | 40 | −11 |

As can be seen the presence of the fluorine-containing polymer in the top coat and in the halide emulsion layers avoided the formation of a positive charge and instead a relatively small negative charge was induced.

EXAMPLE 2

An emulsion was prepared, digested and stabilised in an identical way to the emulsion of Example 1. The emulsion was then divided into three parts III to V. To each part was added the usual coating aids and hardener and the emulsions were coated on both sides of polyester base to give a total silver coating weight of 9 g/m$^2$, so giving three samples III to V of light-sensitive material.

The first sample, sample III, was then coated with a protective all-gelatin top coat containing a gelatin hardener.

The second sample, sample IV, was coated with a protective top coat consisting of 20% poly(hexafluoro-iso-propyl acrylate) and 80% gelatin, and a gelatin hardener, while the third sample, sample V, was coated with a protective top coat consisting of 40% poly(hexafluoro-iso-propyl acrylate) and 60% gelatin, and a gelatin hardener agent.

The samples were then dried and tested as in Example 1 and the results are given in the following Table II.

TABLE II

| Sample | Emulsion Poly(hexafluoro-iso-propyl acrylate) g/mole AgX | Top Coat % Poly (hexafluoro-iso-propyl acrylate) | Induced Static Charge (Volts) |
|---|---|---|---|
| III | 0 | 0 | +44 |
| IV | 0 | 20 | +37 |
| V | 0 | 40 | +24 |

As can be seen from these results the presence of the fluorine-containing polymer in the top coat reduced the positive static charge induced by friction.

EXAMPLE 3

An emulsion was prepared, digested and stabilised in identical fashion to the emulsion in Example 1. The emulsion was divided into four parts and to each part was added the usual coating aids and hardener. The emulsions were then coated on both sides of polyester bases to give a total silver coating weight of 9 g/m$^2$.

The first coated sample, sample VI, was then coated with a protective all-gelatin top coat containing a gelatin hardener.

The second sample, sample VII, was coated with a protective top coat consisting of 20% poly(2,2,3,3,4,4,4-heptafluoro-n-butyl acrylate) and 80% gelatin, and a gelatin hardener, the third sample, sample VIII was coated with a protective top coat consisting of 30% poly(2,2,3,3,4,4,4-hepta-fluoro-n-butyl acrylate) and 70% gelatin and a gelatin hardener, while the fourth sample, sample IX, was coated with a protective top coat consisting of 40% poly(2,2,3,3,4,4,4-hepta-fluoro-n-butyl acrylate) and 60% gelatin and a gelatin hardener.

The samples were dried and tested as in Example 1 and results are given in the following Table III.

TABLE III

| Sample | % Poly(hepta-fluoro-n-butyl acrylate) | % Gelatin | Induced Static Charge (Volts) |
|---|---|---|---|
| VI | 0 | 100 | +101 |
| VII | 20 | 80 | +5 |
| VIII | 30 | 70 | −8 |
| IX | 40 | 60 | −51 |

As can be seen, with poly(2,2,3,3,4,4,4-hepta-fluoro-n-butyl acrylate) in the top coat, it is possible to reduce dramatically the induced static positive charge formed in the absence of the polymer and by choosing a fluorine-containing polymer content in the range of 20 to 30% one can achieve a situation where the induced static charge is practically zero.

EXAMPLE 4

An emulsion was prepared, digested and stabilised in identical fashion to the emulsion in Example 1. The emulsion was then divided into two parts and to each part was added the usual coating aids and hardener. The emulsions were then coated on both sides of polyester bases to give a total silver coating weight of 9 g/m$^2$.

The first coated sample, sample X, was then coated with a protective all-gelatin top coat containing a gelatin hardener. The second sample, sample XI was coated with a protective top coat consisting of 2.25% poly(1,1-dihydroperfluorooctyl methacrylate), 97.75% gelatin and a gelatin hardener.

Both samples were then dried and tested for static charge build-up at a relative humidity of 43% and a temperature of 25° C. by drawing a stainless steel roller across the samples. The resulting induced static charge as a function of the number of passes of the roller is given in the following Table IV.

TABLE IV

| | Induced Static Charge (Volts) | | | | | | | |
|---|---|---|---|---|---|---|---|---|
| Sample | 1 pass | 2 passes | 3 passes | 4 passes | 5 passes | 6 passes | 7 passes | 8 passes |
| X | +11 | +26 | +34 | +40 | +44 | +44 | +44 | +45 |
| XI | + 7 | +18 | +25 | +31 | +33 | +36 | +36 | +36 |

As can be seen from these results the induced static charge was always lower in the sample according to the invention.

As can be seen from the results of these Examples, the incorporation of fluorine-containing polymers into the top coats and optionally additionally into the silver halide layers of light-sensitive materials according to the invention can lead to a considerable reduction in the static charges built up on the surfaces of these materials as compared with light-sensitive material not containing these polymers. More especially, it will be noted that the very undesirable positive static charges can be reduced. The invention therefore, provides a simple way of reducing or avoiding the incidence of "static marks".

The incorporation of these fluorine-containing polymers into the top coats does not have a deleterious effect on the other properties of the photographic materials which was demonstrated by the following tests. The samples I to XI prepared as in the preceding Examples were exposed to a light image and then either developed for 90 seconds in an XU automatic processing machine manufactured by Pako Corporation or developed manually for 5 minutes in a commonly used developer of the following composition:

| | |
|---|---|
| sodium sulphite | 72g |
| Metol | 2.2g |
| hydroquinone | 8.8g |
| sodium carbonate | 48g |
| potassium bromide | 4.0g |
| water to | 1.0 liter |

The photographic properties of the resulting developed films were then determined and are listed below in Table V.

TABLE V

| | Machine Processing | | | | Manual Processing | | | |
|---|---|---|---|---|---|---|---|---|
| Sample | Base + Fog | Speed | Gamma | Maximum Density | Base + Fog | Speed | Gamma | Maximum Density |
| I | 0.15 | 1.79 | 2.91 | 3.04 | 0.15 | 1.71 | 3.11 | 3.01 |
| II | 0.16 | 1.77 | 3.27 | 3.19 | 0.14 | 1.72 | 3.27 | 3.29 |
| III | 0.23 | 1.94 | 3.33 | 3.33 | 0.20 | 1.90 | 2.59 | 3.00 |
| IV | 0.24 | 1.98 | 3.34 | 3.12 | 0.20 | 1.93 | 2.64 | 2.94 |
| V | 0.24 | 1.98 | 3.32 | 3.22 | 0.20 | 1.91 | 2.60 | 2.94 |
| VI | 0.17 | 1.75 | 3.62 | 3.92 | 0.17 | 1.66 | 2.94 | 3.24 |
| VII | 0.16 | 1.75 | 3.57 | 3.64 | 0.15 | 1.66 | 2.76 | 3.08 |
| VIII | 0.16 | 1.76 | 3.60 | 3.83 | 0.15 | 1.68 | 2.77 | 3.02 |
| IX | 0.15 | 1.77 | 3.51 | 3.61 | 0.15 | 1.68 | 2.54 | 2.90 |
| X | 0.21 | 1.83 | 2.82 | 2.75 | 0.16 | 1.78 | 2.38 | 2.61 |
| XI | 0.22 | 1.86 | 3.08 | 2.72 | 0.19 | 1.81 | 2.24 | 2.58 |

As can be seen from these results by comparing the photographic properties of sample I, with sample II, sample III with samples IV and V, sample VI with samples VII to IX, and sample X with sample XI, the addition of the fluorine-containing polymer does not significantly affect the photographic properties of materials of the invention apart from a beneficial change in the static properties of the materials.

EXAMPLE 5

An emulsion was prepared, digested, and stabilized in identical fashion to the emulsion in Example 1. It was then coated on both sides of polyester base to give a total silver coating weight of 9 g/m$^2$ and a protective all-gelatin top coat containing gelatin hardener was applied. One sample of this coating, Sample XII was tested without further treatment, the other Sample XIII had applied to it a layer containing 90% polytrifluoroethyl-acrylate and 10% gelatin.

On testing for static charge buildup, Sample XII gave a strongly positive charge and Sample XIII gave a strongly negative one.

EXAMPLE 6

An emulsion coated base was prepared as in Example 5. Then Sample XIV had applied to it an all-gelatin top coating, Sample XV a top coat comprising 80% gelatin and 20% polyhexafluoroisopropyl acrylate followed by an extra coating comprising 10% gelatin and 90% polyhexafluoroisopropyl acrylate. When tested for static charge buildup after several passes of the roller at 25° C. and 44% relative humidity, Sample XIV gave an average reading of +60 volts and Sample XV an average of −61 volts.

EXAMPLE 7

An emulsion coated base was prepared as in Example 5. Sample XVI was given an all-gelatin top coat, Sample XVII a top coat comprising 50% gelatin and 50% poly trifluoroethylacrylate, and Sample XVIII a top coat comprising 25% gelatin and 75% polytrifluoroethylacrylate. When tested for static charge buildup at 41% relative humidity at room temperature, the average values reached, after many passes of the roller, were:

| Sample | Volts |
|---|---|
| XVI | +77 |
| XVII | +65 |

-continued

| Sample | Volts |
|---|---|
| XVIII | + 5 |

EXAMPLE 8

An emulsion coated base was prepared as in Example 5. Sample XIX was given an all-gelatin top coat, Sample XX a top coat comprising 60% gelatin and 40% polyhexafluoroisopropylacrylate, and Sample XXI a top coat comprising 50% gelatin and 50% polyhexafluoroisopropylacrylate. When tested for static charge buildup at room temperature and 37% relative humidity the average values reached after many passes of the roller were:

| Sample | Volts |
|---|---|
| XIX | +95 |
| XX | +24 |
| XXI | −23 |

What we claim:

1. A light sensitive material which includes a support, at least one layer of a photographic silver halide emulsion on at least one face of the support, and (1) as an outer layer over said layer of emulsion on at least one face of the support, a top coat comprising at least 2% by weight of (1) a fluorine-containing homopolymer or (2) a fluorine-containing copolymer with ethylenically unsaturated comonomers which has been derived from at least 2% by weight of reactants of a fluorine-substituted alkyl ester of an ethylenically unsaturated carboxylic acid wherein there are no more than one H or Cl per two carbon atoms on the fluorinated alkyl group and no more than one skeletal O or N per two carbon atoms on the fluorinated alkyl group or (2) said fluorine-containing polymer being present in at least one emulsion layer on at least one face of the support or in another layer intermediate the top coat and at least one face of the support.

2. A material as claimed in claim 1 which has a top coat consisting essentially of the fluorine-containing polymer.

3. A material as claimed in claim 1 which has a top coating consisting essentially of a mixture of gelatin and at least 2% by weight of said fluorine-containing polymer the latter being compatible with gelatin.

4. A material as claimed in claim 3 in which the fluorine-containing polymer is a homopolymer and constitutes from 2 to 90% by weight of the total weight of the top coat and gelatin comprises the remaining 98 to 10%.

5. A material as claimed in claim 1 in which the top coat comprises the fluorine-containing polymer in the form of a dried latex in a gelatin layer.

6. A material as claimed in claim 1 in which the fluorine-containing polymer has terminal perfluoroalkyl groups.

7. A material as claimed in claim 1 in which the fluorine containing polymer has been formed from a monomer having the general formula:

$$CH_2{=}CHCOOCH_2C_nF_{2n+1}$$

in which n is an integer from 3 to 9.

8. A material as claimed in claim 1 in which the fluorine containing polymer is poly(hexafluoroisopropyl acrylate).

9. A material as claimed in claim 1 in which the fluorine-containing polymer is poly(2,2,3,3,4,4,4,-heptafluoro-n-butyl-acrylate).

10. A material as claimed in claim 1 in which the fluorine-containing polymer is poly(1,1-dihydroperfluorooctyl methacrylate).

11. A material as claimed in claim 1 in which the fluorine-containing polymer has been formed from a monomer having the general formula:

$$CH_2{=}\underset{\underset{CH^3}{|}}{C}\,COO\,CH_2\,(C_nF_{2n+1})$$

where n is an integer from 3 to 9.

* * * * *